United States Patent [19]

Von Osten et al.

[11] 4,285,486

[45] Aug. 25, 1981

[54] CORD HOLDER

[76] Inventors: Jewell Von Osten, Rte. 2, Box 854, Shelton, Wash. 98584; Gilbert F. Duppman, P.O. Box 96, Allyn, Wash. 98524

[21] Appl. No.: 56,819

[22] Filed: Jul. 12, 1979

[51] Int. Cl.[3] ..... A47F 5/00

[52] U.S. Cl. ..... 248/316 B; 24/248 B

[58] Field of Search ..... 248/316 B, 316 R, 316 D, 248/73, 74 A, 74 B, 74 PB, 309, 313; 211/89; 24/249 R, 248 B, 252 R

[56] References Cited

U.S. PATENT DOCUMENTS

| | | | |
|---|---|---|---|
| 3,224,644 | 12/1965 | Davis | 248/313 X |
| 3,310,270 | 3/1967 | Ciancio | 248/313 |
| 3,313,009 | 4/1967 | Beckerer | 24/257 R |
| 3,533,526 | 10/1970 | Adell | 248/313 X |
| 3,669,115 | 6/1972 | Melges | 24/248 R X |
| 3,954,238 | 5/1976 | Nivet | 248/68 CB |

FOREIGN PATENT DOCUMENTS

| | | | |
|---|---|---|---|
| 812529 | 5/1937 | France | 248/74 R |
| 1400577 | 4/1965 | France | 24/248 R |

*Primary Examiner*—J. Franklin Foss

*Attorney, Agent, or Firm*—Christensen, O'Connor, Johnson & Kindness

[57] ABSTRACT

A cord holder, comprising an elongate cylinder, suitable for receiving an electrical cord or rope, and an elongate bracket affixed to or integral with the outer surface of the elongate cylinder, is disclosed. The cylinder and the bracket are formed of a rigid material (e.g., a plastic material, such as polyvinyl chloride). The bracket is circular and terminates in a pair of longitudinal rails that lie parallel to the longitudinal axis of the cylinder. Mounted across one end of the rails is a slotted plate adapted to receive a screw, peg, nail or the like. Depending upon intended use, the elongate cylinder may be: longitudinally hinged and support an apertured block, adapted to receive the prong of a heat control element attached to an electrical cord; only longitudinally hinged; or unitary. The longitudinally hinged forms of the elongate cylinder include a catch adapted to attach the hinged elements together.

7 Claims, 6 Drawing Figures

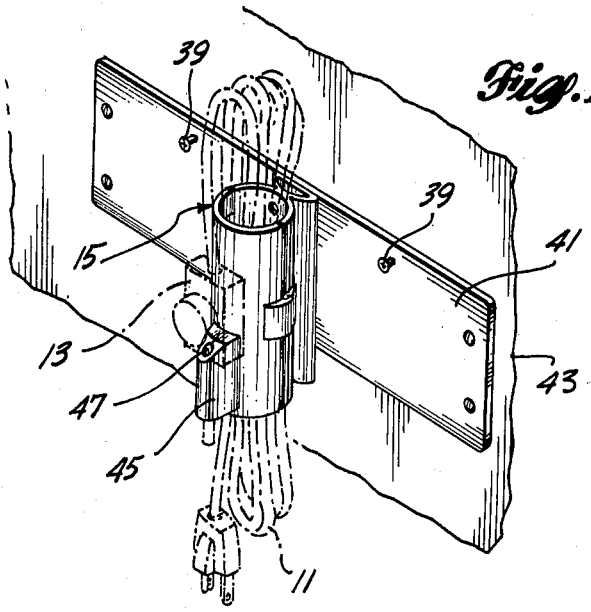
Fig. 1.
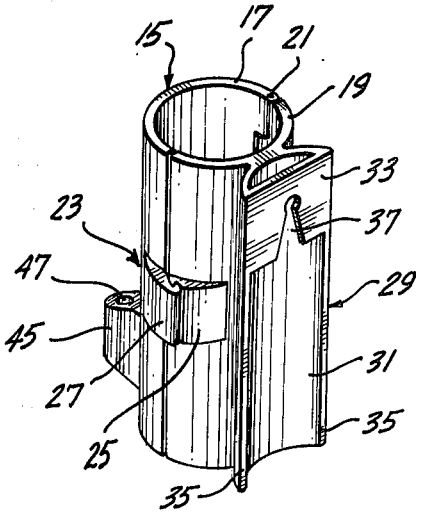
Fig. 2.
Fig. 3.
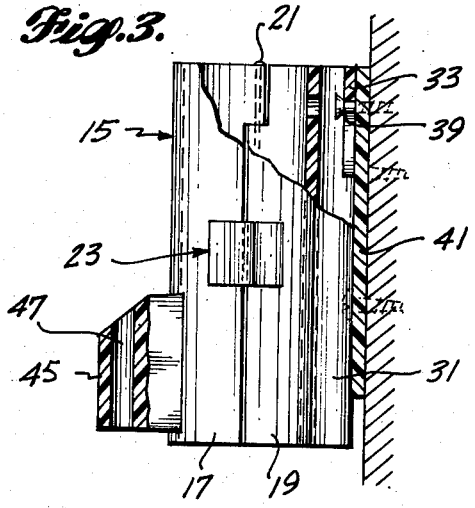
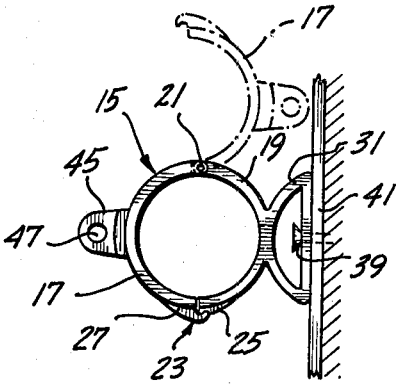
Fig. 4.
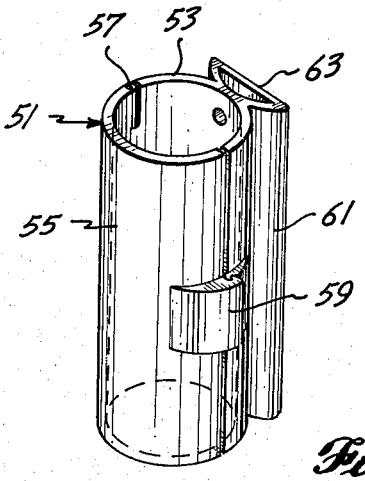
Fig. 5.
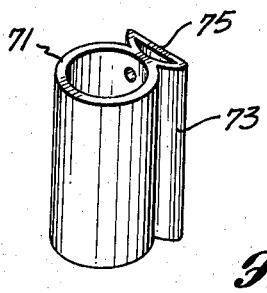
Fig. 6.

CORD HOLDER

TECHNICAL AREA

This invention is directed to holders and, more particularly, holders adapted to hold cords, such as, electrical cords, ropes and the like.

BACKGROUND OF THE INVENTION

Electrical cords, ropes and the like are used to accomplish a variety of tasks in the home, in industry and business, and on board boats. As used alone herein, the term "cord" is to be understood as generic to electrical cords, ropes and the like.

When not is use, cords are stored. One of the problems with storing cords is that, unless cords are carefully coiled and the coils are fastened together such that they cannot be separated, cords become tangled. The tangling problems of a single cord are compounded when several cords are stored together in the same location since the cords often become tangled with one another. For example, in the home, often a plurality of "extension" electrical cords are stored in a drawer. In such instances, several cords often become tangled together, unless they are separately "coiled" and the coils separately fastened by ties or the like. Similar problems exist when several ropes are stored in a confined area onboard a boat. Also, service and repair personnel have a tangling problem when their work requires that they transport several cords in their service or repair vehicle.

While proposals have been made to alleviate the foregoing problems in general, they have not been particularly successful. Clearly it would be desirable to have available cord holders that prevent tangling and allow cords to be stored in a manner that makes them readily available for use.

Therefore, it is an object of this invention to provide a new and improved cord holder.

It is a further object of this invention to provide a cord holder that is particularly suitable for use in holding and storing electrical cords, ropes and the like.

It is yet another object of this invention to provide a cord holder suitable for use in storing cords in a manner that prevents the cords from becoming tangled and makes the cords readily available for use.

SUMMARY OF THE INVENTION

In accordance with this invention, a cord holder suitable for receiving an electrical cord or a rope is provided. The cord holder includes an elongate cylinder adapted to receive the electrical cord or rope and a bracket affixed to, or integral with, the outer surface of the elongate cylinder. The bracket and the cylinder are formed of a rigid material, such as a rigid plastic (for example, polyvinyl chloride).

Preferably, the bracket portion of the cord holder is circular and terminates in a pair of longiudinal rails that lie parallel to the longitudinal axis of the elongate cylinder. Mounted across one end of the rails is a slotted plate adapted to receive a screw, peg, nail or the like. As a result, the holder can be readily mounted on a screw, peg, nail or the like attached to a vertical surface.

Depending upon the intended use of the invention, the elongate cylinder may be: longitudinally hinged or unitary. Further, the elongate cylinder may support an apertured block adapted to receive the prong of a heat control element attached to an electrical cord, for example. Preferably, the longitudinally hinged forms of the invention include two semicircular sections hinged along one longitudinal edge. Further, the longitudinally hinged forms of the invention include a catch located along the nonhinged edges of the two semicircular sections. The catch is adapted to close the elongate cylinder by attaching the hinged sections together.

It will be appreciated from the foregoing summary that the invention provides a cord holder adapted to maintain cords separate, untangled and available for use. The cord holder is formed such that it can be readily mounted on screws, pegs, nails or the like attached to a vertical surface, such as a wall, the inside surface of a door, etc. The hinged forms of the invention allow the cord to be readily removed from the elongate cylinder by releasing the catch and rotating one of the hinged sections of the elongate cylinder away from the other section. The inclusion of an apertured block in certain embodiments of the invention allows the invention to support a heat control element or the like located at one end of an electrical cord to prevent swinging of the element and fraying of the cord. The inclusion of an elongate circular bracket with rails allows the cord holder to be placed on a horizontal surface without the holder rolling; and, assists in stabilizing the holder when it is mounted on a vertical surface.

BRIEF DESCRIPTION OF THE DRAWINGS

The foregoing objects and the many of the attendant advantages of this invention will become more readily appreciated as the same becomes better understood by reference to the following detailed description of preferred embodiments of the invention when taken in conjunction with the accompanying drawings wherein:

FIG. 1 is a perspective view of a preferred embodiment of the invention mounted on a vertical surface;

FIG. 2 is a perspective view taken from another direction of the preferred embodiment of the invention illustrated in FIG. 1;

FIG. 3 is a side elevational view, partially in cross-section, of the embodiment of the invention illustrated in FIG. 1;

FIG. 4 is a top view of the embodiment of the invention illustrated in FIGS. 1–3 showing the two semicircular sections of the elongate cylinder in both closed and opened positions;

FIG. 5 is a perspective view of an alternative embodiment of the invention; and, FIG. 6 is a perspective view of a further alternative embodiment of the invention.

DESCRIPTION OF THE PREFERRED EMBODIMENTS

FIGS. 1–4 illustrate an embodiment of the invention suitable for holding and storing an electrical cord 11 having a heat control element 13 attached to one end. Such electrical cords are widely used with kitchen appliances, such as griddles, electrical frying pans and the like. The cord holder embodiment of the invention illustrated in FIGS. 1–4 includes an elongate cylinder 15 formed of an outer semicircular section 17 and an inner semicircular section 19. The semicircular sections 17 and 19 join along their longitudinal edges and are hinged together by a pair of hinge pins 21 located along one edge. A clasp 23 is provided for attaching the other edges of the semicircular sections 17 and 19 together. The clasp 23 includes a ramp shaped protrusion 25 centrally located adjacent the longitudinal edge of the inner semicircular section 19; and, an overlying hooked-shaped projection 27 attached to an associated region of the outer semicircular section 17.

Affixed to (or formed integrally with) the inner semicircular section 19 is a bracket 29. The bracket 29 includes a circular, elongate portion 31 and a slotted plate 33 located adjacent one end of the elongate portion 31. More specifically, the circular, elongate portion 31 terminates in a pair of edge rails 35. The circular, elongate portion of the bracket 29 is positioned such that the edge rails lie parallel to the longitudinal axis of the elongate cylinder 15. The slotted plate 33 is mounted across the rails 35 at one end thereof. The slotted plate 33 includes a slot 37 adapted to receive a screw, peg, nail or the like 39 attached either to a mounting plate 41 mounted on a vertical surface 43 or mounted on the vertical surface itself. That is, the screw, nail, peg or the like 39 can project outwardly from a vertical surface; or, the screw, nail, peg or the like can be mounted on a plate 41 which, in turn, is mounted on a vertical surface. As a result of this arrangement, the longitudinal axis of the elongate cylinder 15 lies vertical when the cord holder is vertically mounted. The rails 35 assist in supporting the holder because they press against the vertical surface, as illustrated in FIGS. 1 and 3.

Affixed to the outer surface of the outer semicircular section 17 is an apertured block 45. The apertured block 45 is located on the end of the elongate cylinder 15 opposite to the end on which the slotted plate 33 is located. The apertured block 45 includes an aperture 47 adapted to receive the prong of the heat control element 13. The longitudinal axis of the aperture 47 lies parallel to the longitudinal axis of the elongate cylinder 15. Thus, when the cord holder is vertically mounted, the heat control element prong is vertical, whereby the heat control element is supported atop the apertured block 45, as shown in FIG. 1.

FIG. 5 illustrates an alternative embodiment of the invention that is generally similar to the embodiment illustrated in FIGS. 1–4 except that it does not include an apertured block. More specifically, FIG. 5 illustrates a cord holder comprising an elongate cylinder 51 that includes inner and outer semicircular sections 53 and 55. The inner semicircular section 53 is hinged to the outer semicircular section 55 by hinge pins 57 located along adjacent longitudinal edges of the two sections. A clasp 59 similar to the clasp illustrated in FIGS. 1–4 and previously described is provided for attaching the other longitudinal edges of the sections together. Attached to the inner semicircular section 53 is the circular portion 61 of an elongate bracket similar to the bracket 29 illustrated in FIGS. 1–4 and previously described. Thus, in addition to the circular portion 61, the bracket also includes a slotted plate 63 mounted across the rails of the circular portion.

FIG. 6 illustrates a further alternative embodiment of the invention. In the FIG. 6 embodiment, the elongate cylinder 71 is formed in a unitary manner, i.e., it is not formed of two sections. In addition to the elongate cylinder 71, the FIG. 6 embodiment includes a bracket comprising a circular portion 73 and a slotted plate 75.

Regardless of the form of the invention, preferably, all of the elements are formed of a suitably rigid material. The preferred material is a rigid plastic, such as polyvinyl chloride. Alternatively, the cord holder could be formed of a suitably rigid metal, such as aluminium. While generally rigid, the material must have enough flexibility to allow the clasp to be released by pressing the edges of the inner section of the two semicircular section embodiments of the invention toward one another so as to allow the clasp to be disengaged. When the clasp is released, the sections are swung away from one another to readily allow the cord to be laterally inserted or removed from the elongate cylinder, as required. Obviously, the embodiment of the invention illustrated in FIG. 6 requires that the cord be inserted and removed from the ends of the elongate cylinder.

It will be appreciated from the foregoing that the invention provides a cord holder that is relatively rigid and easy to use. The inclusion of a bracket having a pair of rails allows the cord holder to be relatively firmly attached to a vertical surface, as illustrated and generally described above. More specifically, after the slot in the slotted place has been inserted over a suitable nail, screw, peg or the like, the rails rest against the vertical surface and provide additional friction that prevents the holder from moving about. Further, when the holder is separated from the vertical surface and laid on a horizontal surface, e.g., a table, the rails prevent the cord holder from rolling. Hence, the rails perform various functions.

While preferred embodiments of the invention have been illustrated and described, it will be appreciated that various changes can be made therein without departing from the spirit and scope of the invention. If desired, rather than being formed of two semicircular sections, the elongate cylinder can be formed of other sized sections. For example, one of the sections could be a three-quarter size section and the other a quarter size section. Also, the elongate cylinder could have a cross-sectional configuration other than circular—hexagonal, for example. Further, elements other than heat control elements attached to the end of an electrical cord can be supported by the apertured block. Moreover, if such elements have more than one probe or a projecting element other than a probe, the apertured block can be formed so as to receive such different types of structures. Finally, different types of clasps can be used to hold the two semicircular sections together. Hence, the invention can be practiced otherwise than as specifically described herein.

The embodiments of the invention in which an exclusive property or privilege is claimed are defined as follows:

1. A cord holder for holding a bundle formed of loops of electrical cord, rope and the like comprising:

an elongate cylinder formed of a rigid material, said elongate cylinder formed of inner and outer longitudinal sections hinged together along one of the longitudinal edges of said section;

a clasp integrally formed with said inner and outer longitudinal sections for attaching said sections together along the edge opposed to the hinged together edge of said sections; and, an elongate bracket formed of a rigid material and including a slot adapted to receive a nail, screw, peg or the like, said elongate bracket including an elongate circular portion having a longitudinal axis lying parallel to the longitudinal axis of said elongate cylinder, said elongate circular portion affixed to the outer surface of the inner longitudinal section of said elongate cylinder, said elongate bracket also including a slotted plate mounted across one end of the rails defined by said circular portion, said slot being formed in said slotted plate.

2. A cord holder as claimed in claim 1 wherein said elongate cylinder and said elongate bracket are formed of a rigid, plastic material.

3. A cord holder as claimed in claim 1 including a support block affixed to the outer surface of said outer longitudinal section of said elongate cylinder.

4. A cord holder as claimed in claim 3 wherein said elongate cylinder and said elongate bracket are formed of a rigid plastic material.

5. A cord holder as claimed in claim 3 wherein said support block includes an aperture.

6. A cord holder as claimed in claim 5 wherein said aperture has a longitudinal axis that lies parallel to the longitudinal axis of said elongate cylinder.

7. A cord holder as claimed in claim 6 wherein said elongate cylinder and said elongate bracket are formed of a rigid plastic material.

* * * * *